US010655293B2

(12) United States Patent
Schmand et al.

(10) Patent No.: US 10,655,293 B2
(45) Date of Patent: May 19, 2020

(54) DEVICE AND METHOD FOR GROUND FREEZING

(71) Applicant: LINDE AKTIENGESELLSCHAFT, Munich (DE)

(72) Inventors: Ralf Schmand, Unterschleißheim (DE); Abraham Sliwo, Walchwil (CH)

(73) Assignee: LINDE AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 16/047,169

(22) Filed: Jul. 27, 2018

(65) Prior Publication Data

US 2019/0048549 A1 Feb. 14, 2019

(30) Foreign Application Priority Data

Aug. 10, 2017 (EP) ..... 17020351

(51) Int. Cl.
*E02D 3/115* (2006.01)

(52) U.S. Cl.
CPC ..... *E02D 3/115* (2013.01)

(58) Field of Classification Search
CPC ..... E02D 3/115; E02D 19/14; E21B 36/001
See application file for complete search history.

(56) References Cited

U.S. PATENT DOCUMENTS 3,882,937 A * 5/1975 Robinson ..... E21B 36/003 165/45
3,943,722 A * 3/1976 Ross ..... E02D 3/115 405/130
4,358,222 A * 11/1982 Landau ..... E02D 19/14 405/130
5,339,893 A * 8/1994 Haynes ..... E02D 19/14 165/45
5,730,550 A * 3/1998 Andersland ..... B09C 1/002 210/610
7,546,873 B2 * 6/2009 Kim ..... C07C 4/02 166/242.1
2007/0267190 A1 * 11/2007 Sopko ..... E02D 3/115 166/242.1
2017/0138010 A1 * 5/2017 Schmand ..... E02D 3/115

FOREIGN PATENT DOCUMENTS

DE 3112291 A1 * 10/1982 ..... E02D 3/115
JP 63083326 A * 4/1988
JP 06173242 A * 6/1994 ..... E02D 3/115

* cited by examiner

*Primary Examiner* — Frederick L Lagman
(74) *Attorney, Agent, or Firm* — Millen White Zelano & Branigan, PC; Brion Heaney

(57) ABSTRACT

A method and device for freezing the ground are disclosed, including a freezing lance which extends along a longitudinal axis and has a pipe mantle that encloses an interior space, wherein the ground surrounding the freezing lance can be cooled by the refrigerant present in a first section of the interior space, a line for supplying the liquid refrigerant in the first section of the interior space, wherein the device has a first end section with a first opening for removing an exhaust gas formed by evaporation of the refrigerant from the interior space, wherein the interior space has a second section for holding the exhaust gas, wherein heat is exchangeable between the exhaust gas and the pipe mantle in the second section, so that the exhaust gas can be heated by heat exchange with the ground adjacent to the freezing lance.

10 Claims, 1 Drawing Sheet

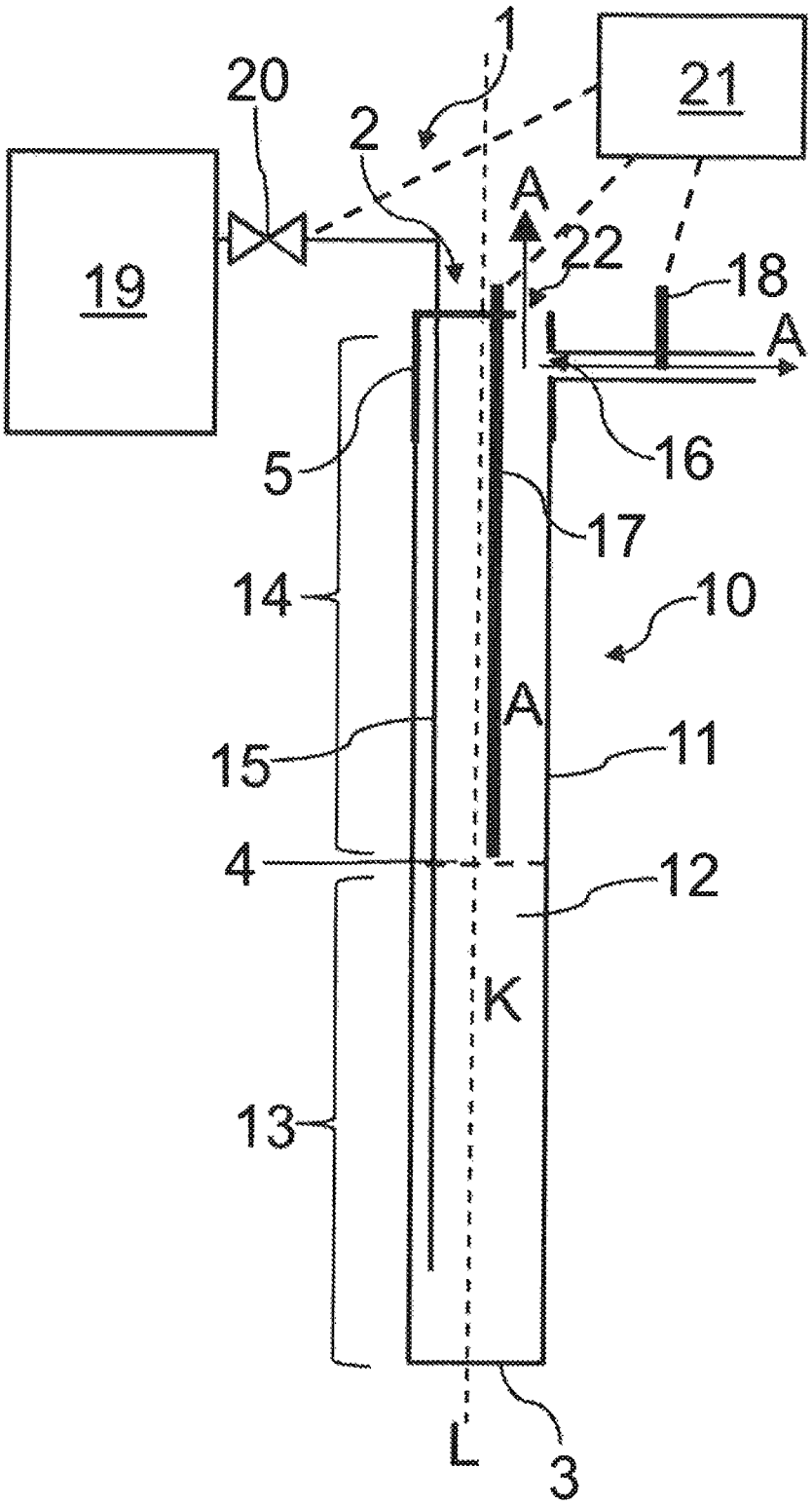
1
20
21
2
A
22
19
18
A
5
16
17
14
10
A
15
11
4
12
K
13
L
3

DEVICE AND METHOD FOR GROUND FREEZING

CROSS REFERENCE TO RELATED APPLICATIONS

This application claims priority from European Patent Application EP 17 020 351.7 filed on Aug. 10, 2017.

BACKGROUND OF THE INVENTION

The invention relates to a device and a method for ground freezing.

Methods for freezing earth, known as "ground freezing" are used according to the related art to solidify or stabilise the ground at construction sites. Methods are known that use liquid nitrogen or liquefied air as the refrigerant, for example. Freezing with a brine which is itself cooled by a refrigeration plant is also known. Freezing with liquid nitrogen takes place considerably faster than with brine, due to the low temperature of the liquid nitrogen, although the operating costs (energy costs) in cases of prolonged freezing times with liquid nitrogen are significantly higher than with brine.

In ground freezing methods according to the related art, devices for ground freezing equipped with "freezing lances" are driven into the ground, the freezing lances having an outer pipe and two downpipes arranged in an interior space.

In this context, according to the related art a refrigerant, for example supercooled liquefied gas such as liquid nitrogen is introduced into the interior space through one of the downpipes. Heat is removed from the surrounding earth by the liquid refrigerant, which is in heat conducting connection with the outer pipe, so that the earth surrounding the freezing lance is frozen.

According to the methods of the related art, the exhaust gas (for example gas-phase nitrogen) produced in the interior space by evaporation of the refrigerant is transported to the earth's surface via the second downpipe.

However, a disadvantage of this arrangement is the formation of a substantial cloud on the surface, which can lead in particular to reduced visibility, thus increasing the risk of accidents.

Furthermore, the cold, gas-phase nitrogen exiting the second downpipe at the surface may collect close to the ground, and this can present a suffocation hazard in this area.

It is therefore the object of the present invention to provide a device and method which represent(s) an improvement over the related art in terms of terms of these stated drawbacks.

This object is solved with the device for ground freezing, comprising a freezing lance which extends along a longitudinal axis and is deigned to be introduced into the earth for the purpose of freezing the ground, wherein the freezing lance includes a pipe mantle that encloses an interior space having a first section for holding a liquid refrigerant, wherein the ground surrounding the freezing lance can be cooled by the refrigerant present in the first section, a line protruding into the interior space for supplying the liquid refrigerant in the first section of the interior space, wherein the device has a first end section, on which a first opening is provided for removing an exhaust gas formed by evaporation of the refrigerant from the interior space, characterized in that the interior space has a second section adjacent to the first section along the longitudinal axis to hold the exhaust gas, so that the exhaust gas can come into contact with the pipe mantle in the second section, and a method for ground freezing comprising introducing a freezing lance into a ground, introducing a liquid refrigerant into a first section of the freezing lance, introducing a refrigerant into the first section of the freezing lance wherein the ground is at least partly frozen, forming an exhaust gas from evaporation of the refrigerant in a second section of the freezing lance which adjoins the first section of the freezing lance wherein the exhaust gas is removed from an interior space at a first end section of the freezing lance, and wherein the exhaust gas exchanges heat with a pipe mantle in the second section of the freezing lance such that the exhaust gas is heated by exchange of heat with the ground adjacent to the pipe mantle.

The device has a first device for temperature measurement positioned at a transition area between the first section and the second section, which first device is designed to measure the temperature of the exhaust gas at the transition area between the first section and the second section.

The first device for temperature measurement is displaceable along the longitudinal axis.

The device has a second device for temperature measurement positioned at the first opening, which device is designed to measure the temperature of the exhaust gas at the first opening.

The refrigerant is a supercooled liquefied gas

The supercooled liquefied gas is liquid nitrogen.

A first temperature of the exhaust gas is measured at the transition area between the first section and the second section.

A second temperature of the exhaust gas is measured at the first opening.

An inflow of the refrigerant into the interior space is controlled or regulated by means of the first temperature and/or the second temperature.

A plurality of freezing lances is introduced into the ground, and wherein the first temperature and/or the second temperature is/are only measured at some of the freezing lances.

The refrigerant is stored in a refrigerant container in the event of overpressure, and wherein the refrigerant is introduced into the first section of the interior space from the refrigerant container, and wherein the exhaust gas is drawn out of the interior space through the first opening by a pressure differential between the interior space and an ambient atmosphere around the freezing lance which is in fluid communication with the first opening.

SUMMARY OF THE INVENTION

A first aspect of the invention relates to a ground freezing device including a freezing lance which extends along a longitudinal axis and is deigned to be introduced into the earth for the purpose of freezing the ground, wherein the freezing lance includes a pipe mantle that encloses an interior space having a first section (also called the freezing zone) for holding a liquid refrigerant, wherein the ground surrounding the freezing lance can be cooled by the refrigerant present in the first section or the heat can be removed from the ground surrounding the freezing lance by means of the refrigerant present in the first section so that the ground is at least partially frozen, and including a pipe which protrudes into the interior space to supply the liquid refrigerant in the first section of the interior space, wherein the device has a first end section, in which a first opening is provided for extracting an exhaust gas formed by evaporation of the refrigerant out of the interior space, wherein the interior space has a second section (also called the warming zone) which adjoins the first section along the longitudinal axis for holding the exhaust gas so that the exhaust gas can come into contact with the pipe mantle in the second section.

With this arrangement, heat can be exchanged particularly in the second section between the exhaust gas present in the interior space or flowing through the interior space and the pipe mantle, so that the exhaust gas can be heated by an exchange of heat which takes place with the earth adjacent to the freezing lance via the pipe mantle.

This means in particular that a separate exhaust gas pipe is eliminated compared with the related art, and instead of this the exhaust gas stream is drawn off at the top end of the freezing lance, in particular at a freeze head.

The advantage of this is that due to the exchange of heat with the surrounding earth via the pipe mantle, exhaust gas exiting at the earth's surface is considerably warmer than in comparable apparatuses of the related art, in which the exhaust gas stream is transported through a downpipe, which in particular is thermally insulated. This has the effect of advantageously reducing cloud formation and the accumulation of exhaust gas at the surface, thus improving safety in the area close to the freezing site. This is important particularly in densely populated areas.

Said first end section may be formed by the freezing lance, or the mantle thereof, or by a separate part, a freeze head, for example.

In particular, the device further includes a freeze connected to the freezing lance on the first end section, wherein the freeze head in particular forms the first end section. The freeze head particularly includes the line for supplying the liquid refrigerant and/or the first opening for extracting the exhaust gas. The freeze head may also form at least a part of the second section for holding the exhaust gas.

The freeze head may be soldered onto the freezing lance, for example. When the device is operated correctly, the freeze head in particular is located outside of the ground.

The earth surrounding the freezing lance is advantageously used for heating the exhaust gas. In this way, separate equipment for heating the exhaust gas stream may be dispensed with, and costs and energy saved.

Since the separate exhaust gas line is not needed, effort and expenses are also reduced in terms of design engineering for the device.

In particular, the first end section adjoins the second section and the pipe mantle has a second end section which adjoins the first section.

When operated correctly, said device may be arranged in such manner for example that the longitudinal axis extends vertically, wherein the first section is arranged below the second section, and wherein the first end section of the pipe mantle is uppermost. In this context in particular, the first end section is arranged outside of the area of earth that is to be frozen. Alternatively, when operated correctly the device may be aligned in any other direction.

The freezing lance may have a total length of 20 metres, for example, wherein the lower 10 metres constitute the first section, and the upper 10 metres constitute the second section. In such case, and opening in the line for supplying the refrigerant may be positioned at a depth of 19.7 metres, for example, that is to say 0.3 metre above the bottom end of the freezing lance.

Alternatively, larger total length of the freezing lance is also conceivable, for example 60 metres or more.

According to one embodiment, the ground freezing device is equipped with a first temperature measurement device, in particular a temperature measuring probe at a transition area between the first section and the second section, which is designed to measure the temperature of the exhaust gas at the transition area between the first section and the second section.

This means for example, a pipe with a temperature sensor extends to a depth which is usable for measuring a reference temperature, in order to be able to adjust and/or set a temperature of the first section required for freezing. As an alternative to a temperature measuring probe, a thermocouple may be fitted directly in the freezing lance, for example, so that the temperature may be measured directly.

In this way, the temperature of the first section may thus be adjusted more accurately than with devices of the related art (optimised temperature management at the point of use), particularly when the exhaust gas stream is heated on the way earth's surface. This results in cost savings, since consumption of refrigerant may be determined more precisely.

The first temperature measurement device may be positioned for example at a depth of 10 metres relative to the earth's surface, if the total length of the freezing lance is 20 metres and the lower 10 metres serve as the first section.

According to a further embodiment, the first temperature measurement device is displaceable along the longitudinal axis.

This advantageously enables various freezing sections (that is to say in particular heights or depths of the first section and the second section) to be adjusted flexibly (for the respective application).

According to a further embodiment, the device ground freezing is equipped with a second temperature measurement positioned at the first opening, which is designed to measure the temperature of the exhaust gas at the first opening.

With a temperature measurement at the first opening, that is to say in particular at the earth's surface, the temperature of the exhaust gas may be determined easily, allowing conclusions to be drawn about the temperature in the first section. This in turn enables the inflow of the refrigerant into the first section to be controlled or regulated to obtain and maintain a certain temperature of the first section.

Of course, a first device for measuring the temperature of the exhaust gas at the transition area between the first section and the second section, and a second device for measuring the temperature of the exhaust gas at the first opening may both be provided.

A second aspect of the invention relates to a method for ground freezing with the aid of a device for ground freezing according to the first aspect of the invention, wherein the freezing lance is at least partially introduced into the ground, and wherein a liquid refrigerant is supplied in the first section of the interior space of the freezing lance, wherein the ground surrounding the freezing lance is cooled by means of the refrigerant present in the first section, so that the ground freezes at least partly, and wherein an exhaust gas is formed by evaporation of the refrigerant in a second section adjoining the first section, wherein the exhaust gas is removed from the interior space at the first end section of the freezing lance, and wherein the exhaust gas exchanges heat with the pipe mantle in the second section, so that the exhaust gas is heated by heat exchange with the ground adjacent to the pipe mantle.

In this context, heat is exchanged between the exhaust gas and the ground mainly via the section of the pipe mantle which surrounds the second section or the warming zone of the interior space.

According to one embodiment, the refrigerant is a supercooled liquefied gas, particularly liquid nitrogen ($N_2$).

According to a further embodiment, a first temperature of the exhaust gas is measured at the transition area between the first section and the second section, in particular by means of the first temperature measurement device.

According to a further embodiment, a second temperature, particularly of the exhaust gas removed from the interior space is measured at the first opening in the first end section of the freezing lance (e.g., on the freeze head), particularly by means of the second temperature measurement device.

According to a further embodiment, an inflow of the refrigerant into the interior space is controlled or regulated by means of the first temperature and/or the second temperature, in particular by means of a control and/or regulating device. In this context, the inflow of the refrigerant into the first section may be controlled or regulated with the aid of a valve, for example, wherein a fluid connection between a refrigerant container and the first section, particularly the line, may be interrupted and/or throttled by means of the valve.

According to a further embodiment, a plurality of freezing lances is introduced into the ground, wherein the first temperature and/or the second temperature is/are only measured on some of the freezing lances.

In particular, the plurality of freezing lances is provided in a "freezing field" which consists of several freezing lances intended to freeze an area of the ground. In this context, a number of the freezing lances (for example 10% of the freezing lances) are equipped with a temperature measurement device, particularly a temperature probe, the other freezing lances are then adapted in particular by adjustment values relating to the exhaust gas (i.e. via the setpoint value for the exhaust gas temperature at the first end section of the respective freezing lance, for example), with the result that the refrigerant stream is adapted in such manner that a certain temperature exists in the first section. Under these circumstances, it is possible to exploit the situation in which the temperatures at different freezing lances are comparable at a certain depth, particularly in a contiguous freezing zone.

In this way, costs of additional temperature measuring devices are saved advantageously.

According to a further embodiment, the refrigerant is stored in a refrigerant container at an overpressure, that is to say at greater pressure than atmospheric pressure, wherein the refrigerant is introduced into the first section of the interior space from the refrigerant container, and wherein the exhaust gas is drawn out of the interior space through the first opening by a pressure differential between the interior space and an atmosphere surrounding the freezing lance which with is fluid communication with the first opening.

According to a further embodiment, the refrigerant is stored in the refrigerant container under absolute pressure of 2 bar to 20 bar, particularly 6 bar to 16 bar, preferably 8 bar to 12 bar.

In this context in particular, atmospheric pressure prevails on the outlet side of the first opening, which means that the system consisting of the refrigerant container and the freezing lance—and the interior space of the freezing lance—is unpressurised on the outlet side of the first opening. The exhaust gas thus flows or is expelled through the first opening into the surrounding atmosphere under the effect of the pressure differential between the interior space and the surrounding atmosphere.

BRIEF DESCRIPTION OF THE DRAWINGS

Further features and advantages of the invention will be explained in the following description of the FIGURE of embodiments of the invention with reference to a FIGURE. The FIGURE shows:

The FIGURE is a schematic representation of a lengthwise cross section through a ground freezing device according to the invention.

The FIGURE shows a device 1 according to the invention in a lengthwise cross section relative to a longitudinal axis L, along which device 1 extends. Device 1 includes a freezing lance 10 with a pipe mantle 11, wherein pipe mantle 11 surrounds an interior space 12, particularly in a circumferential direction relative to longitudinal axis L.

The cross section of pipe mantle 11 may be of any shape relative to the cross section of the longitudinal axis L. In particular, the cross section of pipe mantle 11 may be circular relative to the longitudinal axis L. The pipe mantle may have a diameter of 50 to 60 mm, particularly 54 mm, for example.

In particular pipe mantle 11 is made from a material with good heat conducting properties, copper for example, so that good heat exchange is guaranteed between the refrigerant K in interior space 12 and the surrounding ground.

Pipe mantle 11 includes a first end section 2 arranged on the frontal face thereof with respect to the longitudinal axis L and a second end section 3 arranged on the opposite frontal face to the first end section 2.

In the embodiment shown in the FIGURE, the first end section 2 is formed by a freeze head 5, which is joined to the freezing lance 10 by soldering, for example.

When the device 1 is operated correctly, the longitudinal axis L extends vertically, for example, wherein the first end section 2 forms the upper end of freezing lance 10 and in particular is positioned outside of the area of ground that is to be frozen, and wherein the second end section 3 forms the lower end of freezing lance 10 and in particular is positioned in the ground. The second end section 3 is in particular closed, so that no refrigerant K can escape from the interior space 12 through the second end section 3. However, other arrangements are also possible, in which for example the longitudinal axis extends horizontally or at an angle to the vertical.

The interior space 12 includes a first section 13 or freezing zone for holding a liquid refrigerant K, in particular liquid nitrogen, and a second section 14 or warming zone adjacent to the first section 13 along the longitudinal axis L for holding an exhaust gas A formed by evaporation of the refrigerant K.

Particularly when device 1 is used as intended 1, the second section 14 is arranged above the first section 13. Consequently, the lighter exhaust gas A collects above the liquid refrigerant K.

In particular, a phase boundary exists between the liquid refrigerant K and the gas-phase exhaust gas A in a transition area 4 between the first section 13 and the second section 14. Of course, a liquid-gas mixture of refrigerant K may also be present in or close to this phase boundary.

The FIGURE further shows a line 15 for supplying the liquid refrigerant K in the first section 13 of interior space 12. Line 15 is in particular able to be brought into fluid communication with a refrigerant container 19 for storing the refrigerant K. In this context, refrigerant K is stored in refrigerant container 19 under overpressure, for example at a pressure from 2 bar to 20 bar, particularly 6 bar to 16 bar, preferably 8 bar to 12 bar, and introduced into the interior space 12 from the refrigerant container 19 via the line 15. In particular, the fluid connection between the refrigerant container 19 and the line 15 can be closed and/or throttled with a valve 20, so that a refrigerant stream or inflow of refrigerant into the first section 13 may be controlled via valve 20. Line 15 may have a diameter from 6 mm to 28 mm, particularly 12 mm for example. Line 15 may particularly be thermally insulated.

A first device 17 for temperature measurement, for example a temperature measuring probe, is also represented in the FIGURE. Device 17 for temperature measurement, or a temperature sensor disposed on the end thereof is arranged close to the transition area 4 between the first section 13 and the second section 14, so that the temperature of the exhaust gas A can be measured immediately after refrigerant K has been evaporated. This makes it possible to obtain relatively precise information about the temperature of the first section 13, so that an inflow of refrigerant from refrigerant container 19 into the first section 13 may be regulated with corresponding precision to correct deviations in the temperature from the setpoint value.

The exhaust gas A formed by the evaporation of refrigerant K flows upwards in the second section 14 of the interior space 12, wherein heat is exchanged between the exhaust gas A and the surrounding ground via pipe mantle 11, so that the exhaust gas A heats up as it rises inside the second section 14.

A first opening 16 is provided in freeze head 5 on the first end section 2, that is to say in particular on the upper end of freezing lance 10, for drawing off the heated exhaust gas A, and a second opening 22 is provided for drawing off the heated exhaust gas A. Interior space 12 in particular is in fluid communication with the ambient atmosphere via first opening 16 and second opening 22, wherein atmospheric pressure exists in the ambient atmosphere. Exhaust gas A flows from the first opening 16 and the second opening 22 into the ambient atmosphere in particular due to the pressure differential between the system consisting of refrigerant container 19 and interior space 12 and the ambient atmosphere.

The first opening 16 shown in the FIGURE is positioned perpendicularly to longitudinal axis L, and the second opening 22 is arranged at the axial end of longitudinal axis L, that is to say on the first end section 2. Of course, it is also possible for only opening to be provided in pipe mantle 11. This may be arranged perpendicularly to the longitudinal axis L or on the axial end.

An optional second device 18 for measuring the temperature of the exhaust gas A may be positioned at the first opening 16. In the embodiment represented in the FIGURE, the first opening 16 in particular serves mainly to measure the temperature of exhaust gas A, whereas most of the exhaust gas A exits the interior space 12 and escapes into the ambient atmosphere through the second opening 22. Alternatively, the second device 18 for temperature measurement may be arranged at the first opening 16 instead of at the second opening 22, or a device for measuring the temperature of the exhaust gas A may be provided both at the first opening 16 and at the second opening 22.

The arrangement of the first opening 16 and the second opening 22 shown in the FIGURE may be configured with a T-piece, for example, wherein a first arm of the T-piece is connected to the pipe mantle 11, and wherein a second arm of the T-piece extending perpendicularly to the first arm of the T-piece forms the first opening 16, and wherein a third arm opposite the first arm and extending parallel to the first arm forms the second opening 22.

Also represented in the FIGURE is a control and/or regulating device 21 which is connected with the first device 17 for temperature measurement, the second device 18 for temperature measurement and valve 20 in such manner that a temperature of exhaust gas A may be measured by the first device 17 for temperature measurement and/or the second device 18 for temperature measurement and transmitted as an actual parameter to the control and/or regulating device 21, wherein the control and/or regulating device 21 is designed to regulate valve 20 so that the inflow of refrigerant K from the refrigerant container 19 into the first section 13 of the interior space 12 of freezing lance 10 is adjusted so that the temperature of exhaust gas A is adapted to a predetermined setpoint value.

This setpoint value is in particular selected such that the temperature of refrigerant K is at a temperature required to freeze the earth in the first section 13 (that is to say it is maintained at the temperature or adjusted to the temperature) when the temperature of the exhaust gas A matches the setpoint value.

For example, if the measured temperature of exhaust gas A is higher than a certain setpoint temperature (which is an indication that a temperature of refrigerant K in the first section 13 is too high), refrigerant K may be fed into the first section 13 via valve 20, intermittently for example, thereby lowering the temperature of refrigerant K in the first section 13.

Of course, a corresponding control and/or regulating device 21 may also receive temperature data from only one of the devices 17,18 for temperature measurement (i.e. either with a gas temperature measured at the transition area 4 or with an exhaust gas temperature measured at the first opening 16 on the first end section).

It is also conceivable that the control and/or regulating device 21 controls and/or regulates the inflow of refrigerant K in to the first section 13 not by means of valve 20 but in some other way.

LIST OF REFERENCE SIGNS

1 Device for ground freezing
2 First end section
3 Second end section
4 Transition area
5 Freeze head
10 Freezing lance
11 Pipe mantle
12 Interior space
13 First section or freezing zone
14 Second section or warming zone
15 Line
16 First opening
17 First temperature measurement device
18 Second temperature measurement device
19 Refrigerant container
20 Valve
21 Control and/or regulating device
22 Second opening
A Exhaust gas
K Refrigerant
L Longitudinal axis

What we claim is:

1. A device for ground freezing, comprising a freezing lance which extends along a longitudinal axis and is designed to be introduced into the earth for the purpose of freezing the ground, wherein the freezing lance includes a pipe mantle that encloses an interior space having a first section for holding a liquid refrigerant, wherein the ground surrounding the freezing lance can be cooled by the refrigerant present in the first section, a line protruding into the interior space for supplying the liquid refrigerant into the first section of the interior space, wherein the device has a first end section, on which a first opening is provided for removing an exhaust gas, formed by evaporation of the refrigerant, from the interior space, and wherein the interior space has a second section adjacent to the first section along the longitudinal axis to hold the exhaust gas, so that the exhaust gas can come into contact with the pipe mantle in the second section, wherein a first device for temperature measurement of the exhaust gas is positioned at a transition area between the first section and the second section and said first device for temperature measurement is used to control or regulate inflow of liquid refrigerant into the interior space.

2. The device for ground freezing according to claim 1, wherein the first device for temperature measurement is displaceable along the longitudinal axis.

3. The device for ground freezing according to claim 1, further comprising a second device for temperature measurement positioned at the first opening, wherein said second device for temperature measurement is designed to measure the temperature of the exhaust gas at the first opening.

4. A method for ground freezing comprising:

introducing a freezing lance into the ground, said freezing lance including a pipe mantle which encloses an interior space having a first section and a second section, introducing a liquid refrigerant into said first section of the interior space to at least partially freeze the ground, forming an exhaust gas from evaporation of the refrigerant in said interior space wherein said exhaust gas is held in said second section of the interior space which adjoins the first section of the interior space, wherein the exhaust gas exchanges heat with the pipe mantle in the second section of the freezing lance such that the exhaust gas is heated by exchange of heat with the ground adjacent to the pipe mantle, removing the exhaust gas from the interior space at a first end section of the freezing lance, measuring a first temperature of the exhaust gas at a transition area between the first section and the second section, and, wherein the measured first temperature of the exhaust gas is used to control or regulate inflow of liquid refrigerant into the interior space.

5. The method according to claim 4, wherein the refrigerant is a supercooled liquefied gas.

6. The method according to claim 5, wherein the supercooled liquefied gas is liquid nitrogen.

7. The method according to claim 4, wherein said first end section is provided with a first opening for the removal of the exhaust gas from the interior space, and further comprising measuring a second temperature of the exhaust gas at the first opening.

8. The method according to claim 7, wherein the measured second temperature of the exhaust gas is used control or regulate inflow of the liquid refrigerant into the interior space.

9. The method according to claim 4, wherein a plurality of freezing lances is introduced into the ground, and wherein the first temperature is only measured at some of the freezing lances.

10. The method according to claim 4, wherein the refrigerant is stored at elevated pressure in a refrigerant container, and wherein the refrigerant is introduced into the first section of the interior space from the refrigerant container, and wherein the exhaust gas is withdrawn from the interior space through the first opening by a pressure differential between the interior space and an ambient atmosphere around the freezing lance which is in fluid communication with the first opening.

* * * * *